United States Patent [19]

Jacobs

[11] Patent Number: 4,759,641

[45] Date of Patent: Jul. 26, 1988

[54] VALVE BAG

[75] Inventor: Richard W. Jacobs, Eden Prairie, Minn.

[73] Assignee: Bemis Company, Inc., Minneapolis, Minn.

[21] Appl. No.: 350,760

[22] Filed: Feb. 22, 1982

[51] Int. Cl.[4] ..... B65D 30/24

[52] U.S. Cl. ..... 383/44; 141/286; 141/68

[58] Field of Search ..... 229/62.5, DIG. 14; 150/9; 141/286, 68, 1; 383/44

[56] References Cited

U.S. PATENT DOCUMENTS

| | | | |
|---|---|---|---|
| 2,040,338 | 5/1936 | Rosmait | 229/62.5 |
| 2,046,761 | 7/1936 | Andreas | 226/48 |
| 2,105,376 | 1/1938 | Scott | 229/62.5 |
| 2,176,499 | 10/1939 | Hoppe et al. | 229/62.5 |
| 2,251,659 | 8/1941 | Bushman | 226/48 |
| 2,886,072 | 5/1959 | Hoff | 141/59 |
| 2,964,070 | 12/1960 | Linhardt | 141/7 |
| 3,542,091 | 10/1970 | Carter et al. | 141/65 |
| 3,707,172 | 12/1972 | Obara | 141/59 |
| 4,185,669 | 1/1980 | Jevakohoff | 141/59 |

FOREIGN PATENT DOCUMENTS

| | | |
|---|---|---|
| 587187 | 1/1930 | Fed. Rep. of Germany . |
| 345842 | 9/1956 | Switzerland . |

*Primary Examiner*—Henry J. Recla
*Assistant Examiner*—David Voorhees
*Attorney, Agent, or Firm*—Senniger, Powers, Leavitt and Roedel

[57] ABSTRACT

Valve bags having a vent for exit of air from the bag as it is filled, with a filter for the vent incorporated in the bag as part of the bag for preventing escape of product from the bag. In each of two types of bag disclosed, the filter is formed as a pocket for receiving a vacuum member for evacuating air from the bag through the filter. In one of these two types, the valve is at a corner at one end of the bag and the pocket is at the opposite corner at this end. In the other, the valve and pocket are at one and the same corner, the pocket being under the valve. In a third type of bag disclosed, the filter is part of a valve sleeve for the bag.

10 Claims, 11 Drawing Sheets

VALVE BAG

BACKGROUND OF THE INVENTION

This invention relates to valve bags, and more particularly to valve bags with a vent for exit of air from the bag.

In filling a valve bag with a fluent product, such as a powder, the valve is opened, the bag is placed on a filling spout, the spout then extending through the valve into the bag, the requisite amount of product is delivered into the bag through the spout, and the filled bag is withdrawn from the spout. It is desirable that provision be made for venting air from the bag during the filling operation to prevent ballooning of the bag, but it is also desirable, and necessary in cases of filling bags with certain products such as environment-contaminating products, to prevent escape of product in the air exiting from the bag. Reference may be made to such prior art as U.S. Pat. Nos. 2,046,761, 2,251,659, 2,886,072, 2,964,070, 3,542,091, 3,707,172 and 4,185,669, German patent No. 587,187 and Swiss patent No. 345,842 describing various approaches to the problem of venting while preventing escape of product into the atmosphere.

SUMMARY OF THE INVENTION

Among the several objects of the invention may be noted the provision of an improved valve bag adapted for venting air from the bag during filling while inhibiting escape of product from the bag, enabling quicker, more accurate and cleaner filling; the provision of such a valve bag which enables the withdrawal of air from the bag by vacuum without withdrawing product; the provision of such a valve bag in which air is vented via a filter incorporated in the bag as part of the bag; the provision of such a valve bag adapted for reception of a vacuum member (e.g. a vacuum wand or probe) for evacuating air from the bag through the filter; and the provision of such valve bags which are adapted for economical, mass production.

Generally, a bag made in accordance with this invention has end closures and a valve in one of the end closures adapted to be opened for placement of the bag on a filling spout for filling the bag with product. This one end closure (having the valve) has a passage for insertion of a vacuum member for exhausting air from the bag as the bag is filled, and a filter for the passage. The filter is constituted by flexible sheet filter material which is air permeable for passage of air from the bag into the vacuum member but product impermeable to inhibit escape of product from the bag, the sheet filter material being secured to the bag.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
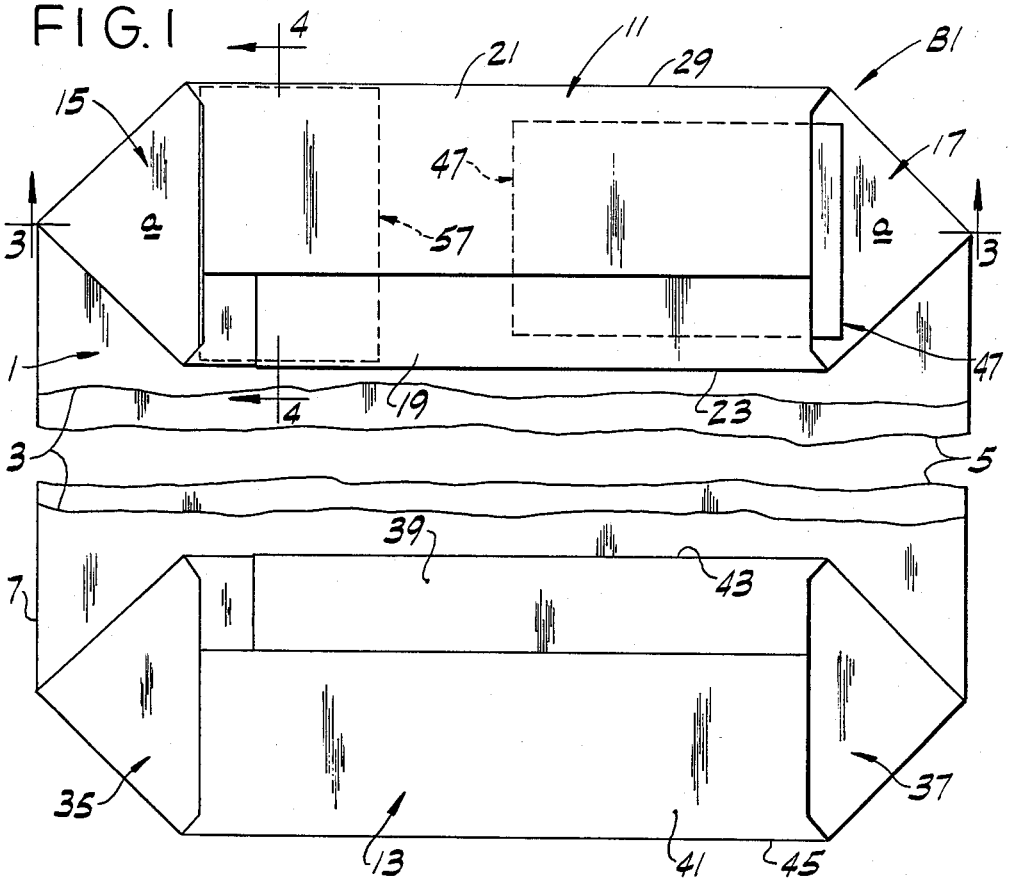
FIG. 1 is view of a first embodiment of the valve bag of this invention, in which the valve is at one corner of the bag at one end of one of the end closures (the "valved end closure") of the bag and the filter is at the other end of this end closure, the filter being referred to as of "hinge-type" construction, the central portion of the bag being broken away to reduce the height of the view.
Figure 2:
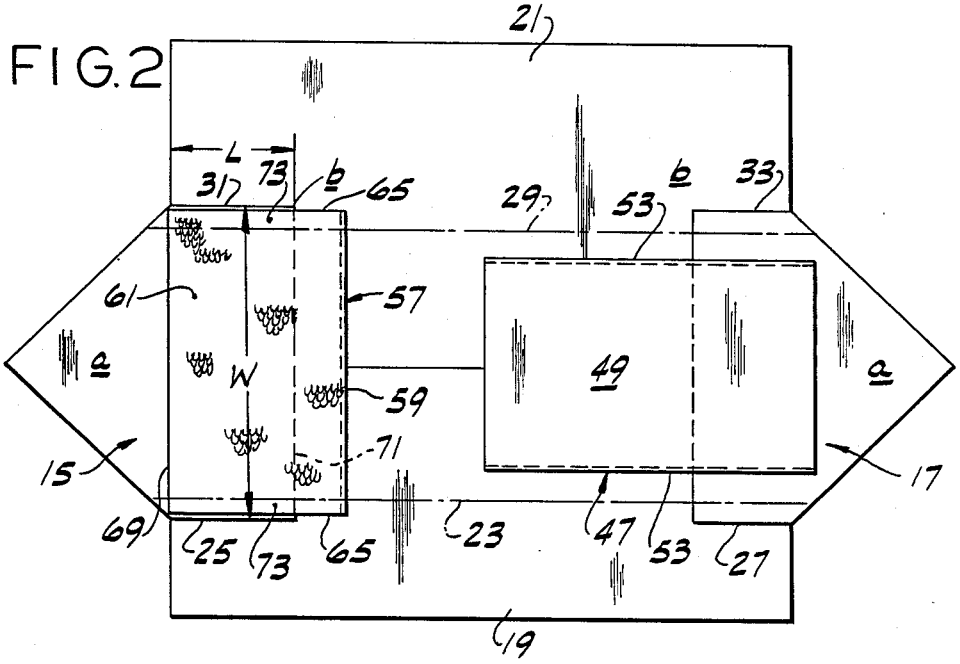
FIG. 2 is a view of the valved end closure of the FIG. 1 bag as it appears opened up.
Figure 3:
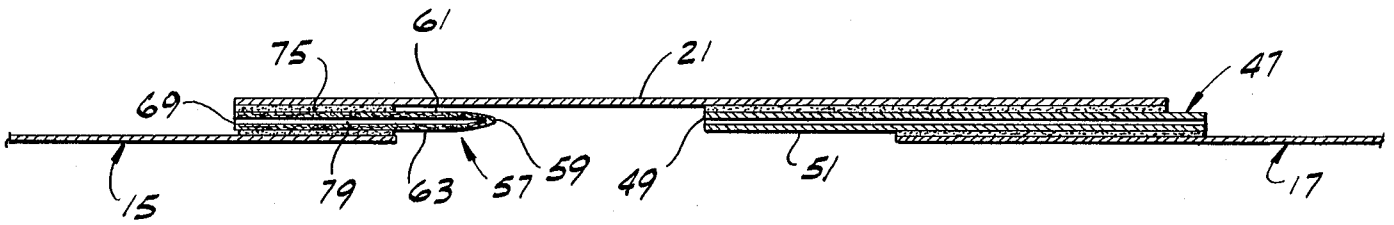
FIG. 3 is a section on line 3—3 of FIG. 1 showing the valve and the filter.

Referring to FIGS. 1–5 of the drawings, a valve bag of this invention, designated in its entirety by the reference character B1, is shown to be formed from a flat (ungusseted) bag tube 1, the walls of which are designated 3 and 5, 3 being referred to as the front wall, 5 being referred to as the back wall. The side edges of the tube, constituted by folds in the bag material, are designated 7 and 9, 7 being the left and 9 being the right side edge as viewed in FIG. 1.

The bag may be a paper bag, in which case it is generally a multiwall bag, formed by combining a number of webs of paper, forming the combined webs into tubing with a longitudinal seam, and segmenting the tubing into individual bag tubes, all in conventional well-known manner. Or the bag may be made of plastic, in which case it is generally a single-ply plastic bag, formed by extruding a single-ply plastic tube, flattening the tube, and segmenting it into individual bag tubes, all in conventional well-known manner. For convenience, the bag is illustrated in FIGS. 1–5 as a single-ply bag, since as far as this embodiment is concerned, it makes no difference if the bag is a single-ply or a multi-ply bag.

As shown in FIG. 1, the bag has top and bottom end closures 11 and 13, each formed in generally conventional manner by opening up the respective end of the tube to form first and second inwardly directed end flaps and first and second side flaps. The end flaps of the top closure, which may be referred to as the valved end closure, are designated 15 and 17; the side flaps of the top closure are designated 19 and 21. The walls of the tube are slit at the ends in conventional manner so that each end flap has a triangular outer part a and a rectangular inner part b. The top closure is formed by folding the first side flap 19 over on a fold line 23 extending transversely of the tube and lying somewhat within the adjacent side edges 25 and 27 of the end flaps 15 and 17 (the side edges of rectangular parts b of the end flaps), then folding the second side flap 21 over on a fold line 29 extending transversely of the tube and lying somewhat within the adjacent side edges 31 and 33 of the end flaps, and securing these flaps together, by means of adhesive in the case of paper bags, and either by adhesive or by heat sealing in the case of plastic bags. The bottom closure is formed in similar manner, its end flaps being designated 35 and 37, its first and second side flaps being designated 39 and 41, and its folds 43 and 45.

Figure 5:
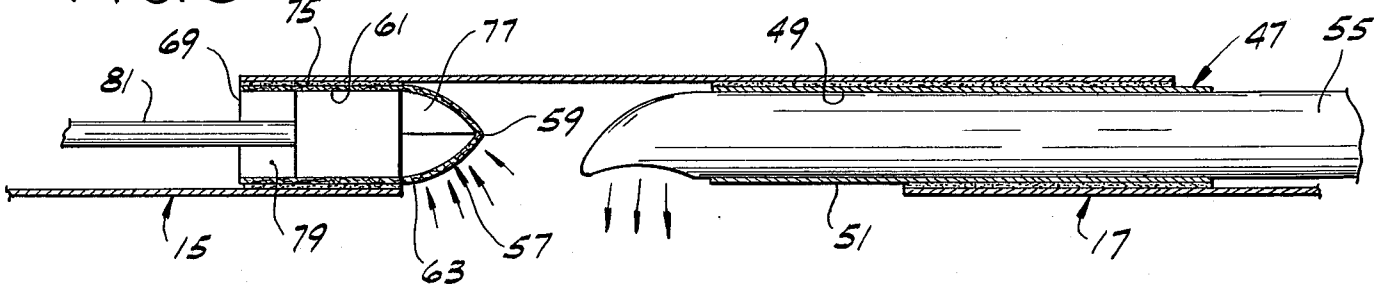
FIG. 5 is a view in section similar to FIG. 3 showing the FIG. 1 bag placed on a filling spout and a vacuum member inserted at the opposite end from the valve for exhausting air from the bag through the filter.
Figure 6:
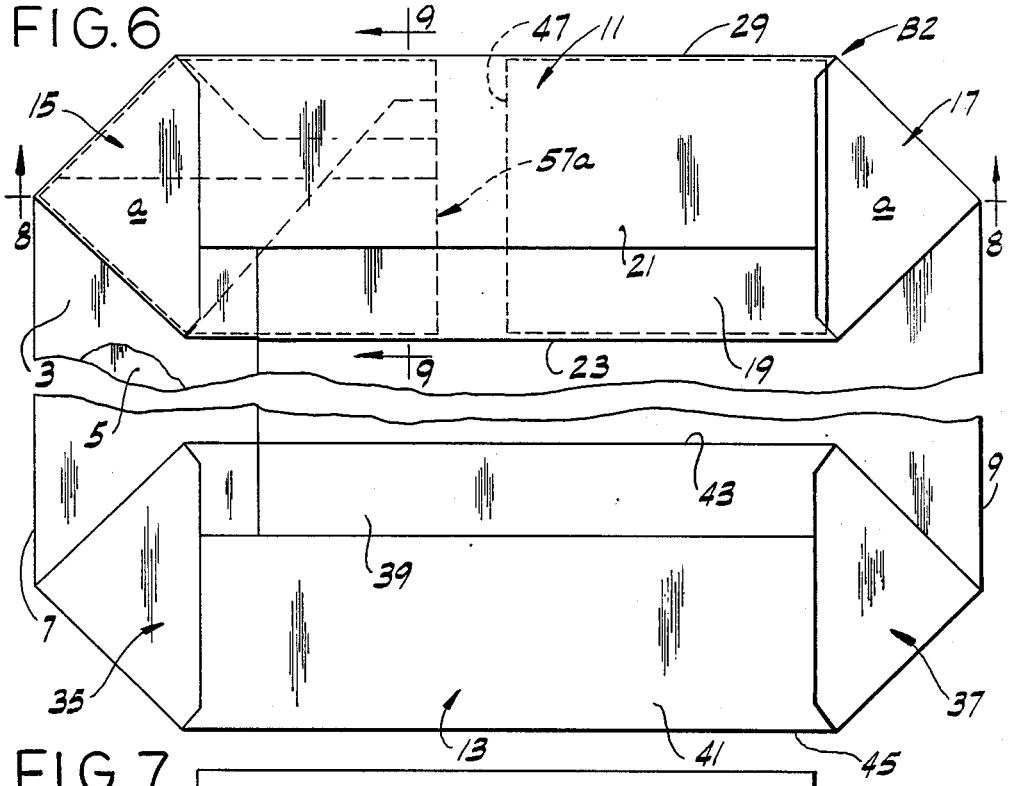
FIG. 6 is a view similar to FIG. 1 of a second embodiment of the valve bag of this invention, also one in which the valve is at one corner of the bag at one end of the valved closure of the bag and the filter is at the other end of the valved end closure, the filter being referred to as of "structural strip type" construction.
Figure 7:
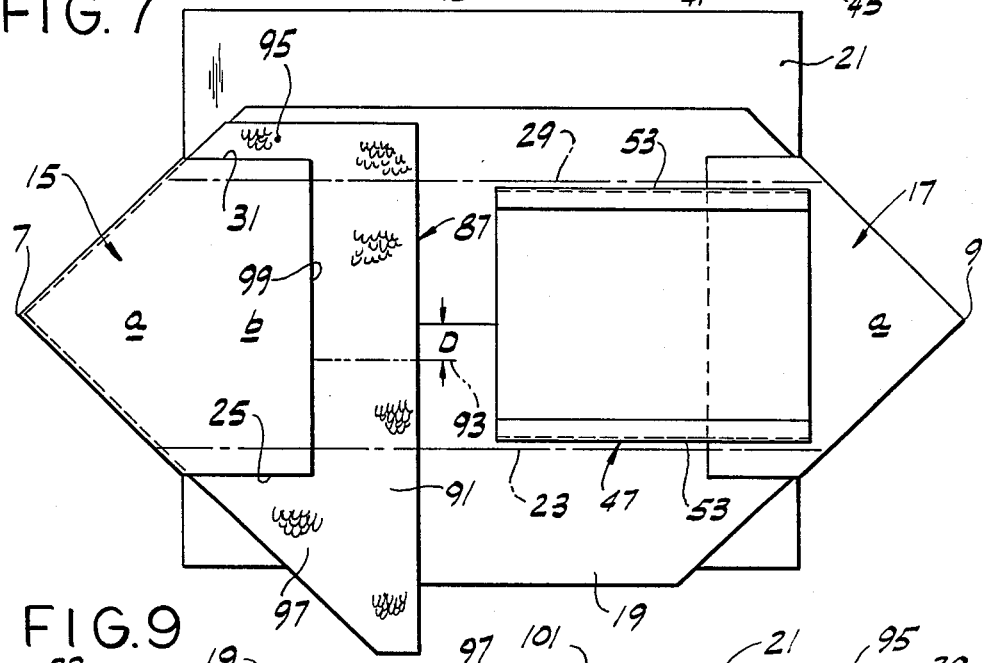
FIG. 7 is a view of the valved end closure of the FIG. 6 bag as it appears opened up.
Figure 9:
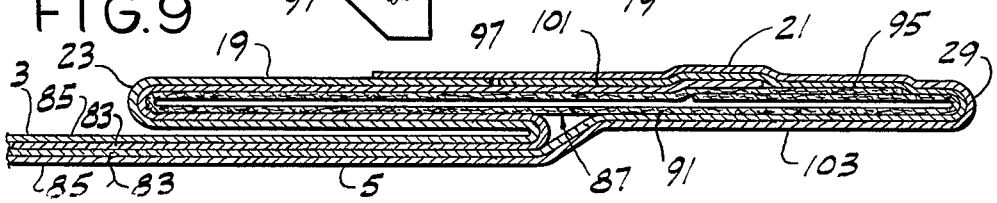
FIG. 9 is a section on line 9—9 of FIG. 6 showing the filter.
Figure 8:
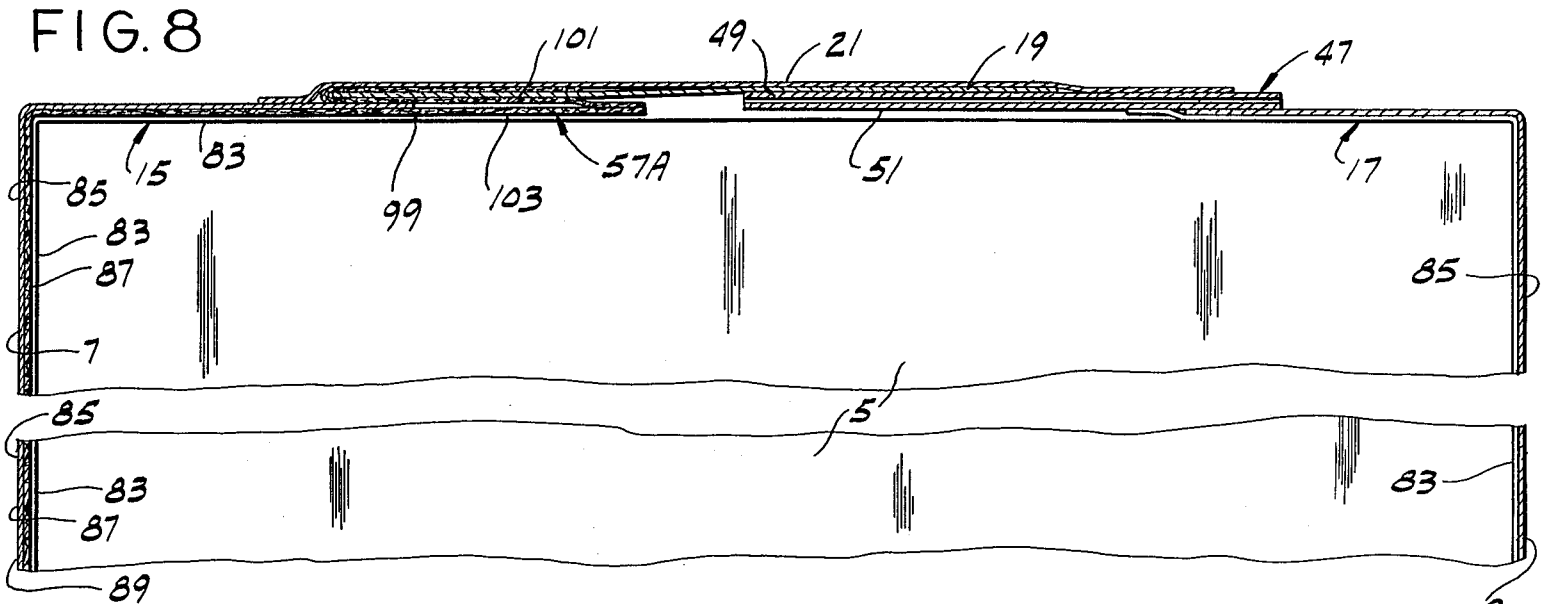
FIG. 8 is a section on line 8—8 of FIG. 6 showing the valve and the filter.

With regard to the top closure 11, which is the valved end closure of the bag, before the side flaps 19 and 21 are folded over on lines 23 and 25, a valve sleeve 47 is secured to the end flap 17, which may be referred to as the valve flap. The valve sleeve is constituted by a flat tube of suitable flexible material; it may be a paper or a combination paper and plastic sleeve in the case of bag B1 being a paper bag, or a plastic sleeve in the case of bag B1 being a plastic bag. Where the bag is to be filled with certain products such as, for example, products which may present a toxicity problem, it may be desirable or necessary to provide some means (e.g. water soluble adhesive means) in the valve sleeve for sealing it after the bag has been filled and taken off the filling spout. This, however, is not a part of the present invention. In the case of a paper bag, the valve sleeve may be suitably adhered to the valve flap 17; in the case of a plastic bag it may be heat sealed or otherwise adhered to the valve flap. The sleeve has a top wall 49 and a bottom wall 51 joined at the sides of the sleeve as indicated at 53, and is dimensioned to fit snugly on a filling spout 55 as illustrated in FIG. 5. The width of the sleeve is somewhat less than the spacing of the fold lines 23 and 25 and it is secured to flap 17 generally centered on the flap.

Also, before the side flaps 19 and 21 are folded over on lines 23 and 25, a filter element generally designated 57 is secured to the end flap 15, which may be referred to as the filter flap. The filter element is constituted by a rectangular piece of suitable flexible filter material, such as a saturated or latex-reinforced filter paper commonly used in vacuum cleaner bags, or a spun-bonded high density polyethylene material such as that sold under the trade name TYVEK by E.I. duPont de Nemours and Co., or a spun-bonded polypropylene material such as that sold under the trade name TYPAR by duPont, or a spun-bonded nylon such as that sold under the trade name CEREX by Monsanto Chemical Co. The rectangular piece of filter material has a width corresponding generally to the width W of the rectangular part b of end flap 15 and a length somewhat greater than the length L of part a. It is folded in half on a fold line 59 extending transversely of its length so as to have a top half 61 and a bottom half 63, and has its bottom half secured on top of the rectangular part b of the filter flap 15, as by means of adhesive or heat sealing with its side edges (indicated at 65 in FIG. 2) generally in line with or closely adjacent the side edges 25, 33 of the rectangular part b of flap 15, with its open end 69 at the outer end of rectangular part 15*b*, and with its folded end 57 projecting inward from the inner end edge 71 of the flap 15.

Figure 4:
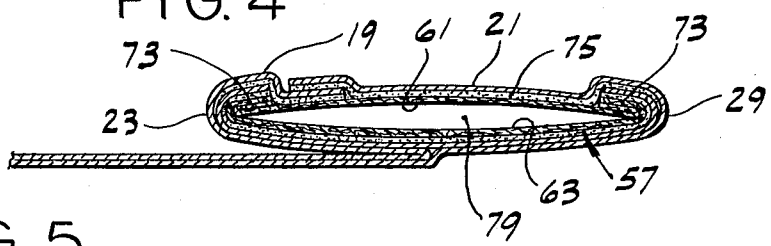
FIG. 4 is a section on line 4—4 of FIG. 1 showing the filter.

When the side flaps 19 and 21 are folded over (19 first and then 21) on the fold lines 23 and 29, since the fold lines are within the side edges 65 of the folded piece of filter material 57, the side margins 73 of the folded piece of filter material 57 are folded over as shown in FIG. 4. The side flap 21 becomes secured (as by means of adhesive 75 on the side flap) to the top half or wall 61 of the folded piece of filter material. The latter is then in the form of a pocket, open at its outer end at 69 to receive a vacuum member 77, in the manner illustrated in FIG. 5. Since the valve sleeve 47 is narrower than the spacing of the fold lines 23 and 29 and its side edges 53 lie within these fold lines, its side margins do not become folded over.

The valve sleeve 47 is adapted to be opened for placement of the bag B1 on a filling spout 55 as shown in FIG. 5, the spout extending through the sleeve into the bag for filling the bag with product delivered through the spout into the bag. The filter element or pocket 57 defines a passage 79 open at 69 for insertion of vacuum member 77 for exhausting air from the bag as it is filled, the pocket acting as a filter for the passage, being air permeable for passage of air out of the bag and into the vacuum member, but product impermeable to inhibit escape of product from the bag. The vacuum member 77 is in the form of a wand or probe having a relatively snug fit in the pocket, and being connected at its outer end 81 to a pump (not shown) for suctioning air from the bag through the sheet filter material of the pocket and thence out through the vacuum member. When the bag has been filled, the flow of product through the spout 55 into the bag is cut off, the vacuum member 77 is removed, and the bag taken off the spout. The valve sleeve 47 closes to keep the product in the bag, and, if it has sealing means, is sealed.

FIGS. 6–10 illustrate a second embodiment of the valve bag of this invention, designated in its entirety by the reference character B2, similar to the first embodiment except for the manner in which the filter pocket is provided. Thus, bag B2 like bag B1 has front and back walls 3 and 5, side edges 7 and 9, and top and bottom end closures 11 and 13, the top end closure which again is the valve end closure having end flaps 15 and 17, and the bottom end closure having end flaps 35 and 37. The bag B2 is a multiwall paper bag, shown as having two plies 83 and 85, 83 being the inner and 85 the outer ply. It will be understood, of course, that bag B2 may have more than two plies, and may have various suitable stepped-end arrangements as well known in the art of multiwall valve bags. The sleeve 47 is generally the same as in bag B1. The filter element of bag B2, designated 57A to distinguish it from the filter element 57 of bag B1, is constituted by a protruding or projecting end portion of a strip 87 of the filter material incorporated between the plies of the tubing from which the bag is made.

More particularly, strip 87 is a strip of the filter material having a width greater than width W of the rectangular part a of the end flap 15 of the bag B2, extending between the plies 83 and 85 of the bag and offset with respect to the side edge or side fold 7 of the bag, having its lower end 89 spaced inward (upward) from the bottom end of the tube from which the bag B2 is made, and extending beyond the upper end of the bag tube a distance corresponding to the spacing of its lower end 89 from the lower end of the bag tube to provide a protruding or projecting end 91 of the strip at the top of the bag tube for forming the filter element. As appears in FIG. 7, the center line 93 of the strip is offset a distance D from the side edge or side fold 7 (the latter defining the center line of the end flap 15) so that the strip has a portion 95 on the outside of the side edge 31 of part b of flap 15 and a wider portion 97 on the outside of the side edge 25 of part b.

The strip 87 is sandwiched between the plies 83 and 85 with its one end 89 spaced inward from the bottom end of the bag tube from which the bag B2 is made and extending at its other end beyond the upper end edge 99 of the bag tube. This is done in the operation of forming the tubing and segmenting it into individual bag tubes, by combining a continuous strip of the filter material with the webs of paper which form the plies 83 and 85 as the webs are fed through the apparatus for forming the tubing (the tube) and perforated as well known in the bag manufacturing art. As the strip is fed forward, it is perforated at bag length intervals with its perforations offset longitudinally of the webs (and strip) from the web perforations, all in such manner that, when the tubing is snapped apart at the lines of perforations in the webs to form the individual bag tubes, the continuous strip is snapped apart to provide the individual strips in each bag tube with each individual strip projecting from the respective bag tube at what becomes the valve end of the bag tube.

When the side flap 19 is folded over on line 23, and the side flap 21 is folded over on line 29, lateral portions 95 and 97 of the end portion 91 of the strip are folded over on the fold lines with these flaps, with the result that the end portion 91 of the strip has a top section or wall 101 (consisting of the folded-over portions 95 and 97) and a bottom section or wall 103, these sections or walls being integrally joined at the fold lines 23 and 29, and being sealed together as by a suitable adhesive as indicated at 105 to form the inner end of the pocket 57A. As in the bag B1, the open outer end of pocket is designated 69, and the passage in the pocket is designated 79.

Figure 10:
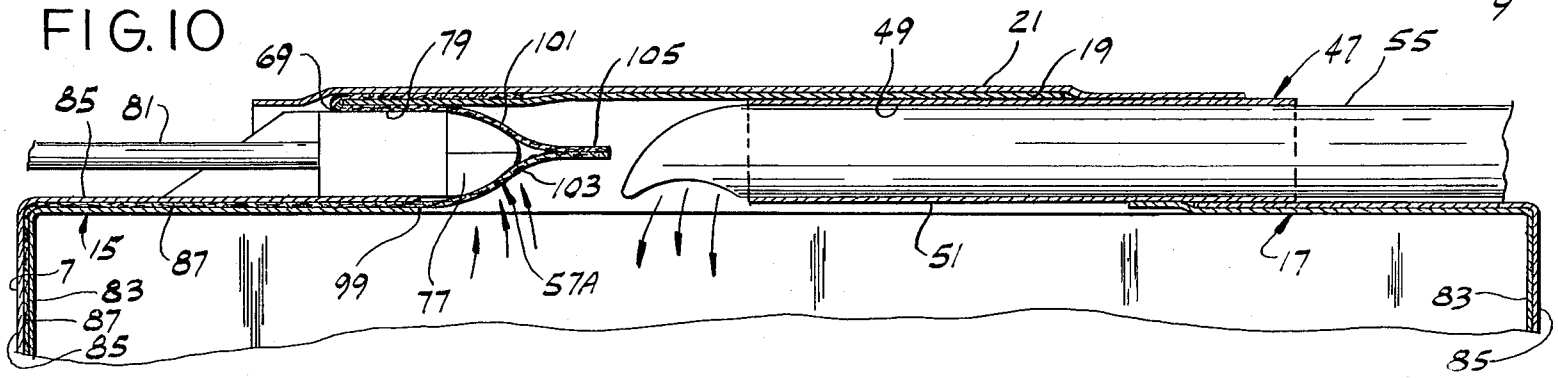
FIG. 10 is a view in section similar to FIG. 8 showing the FIG. 6 bag placed on a filling spout and a vacuum member inserted at the opposite end from the valve for exhausting air from the bag through the filter.

In the filling of the bag B2, the vacuum member 77 is inserted in the pocket 57A as illustrated in FIG. 10, in the same manner as it is inserted in the pocket 57 of the bag B1.

Figure 15:
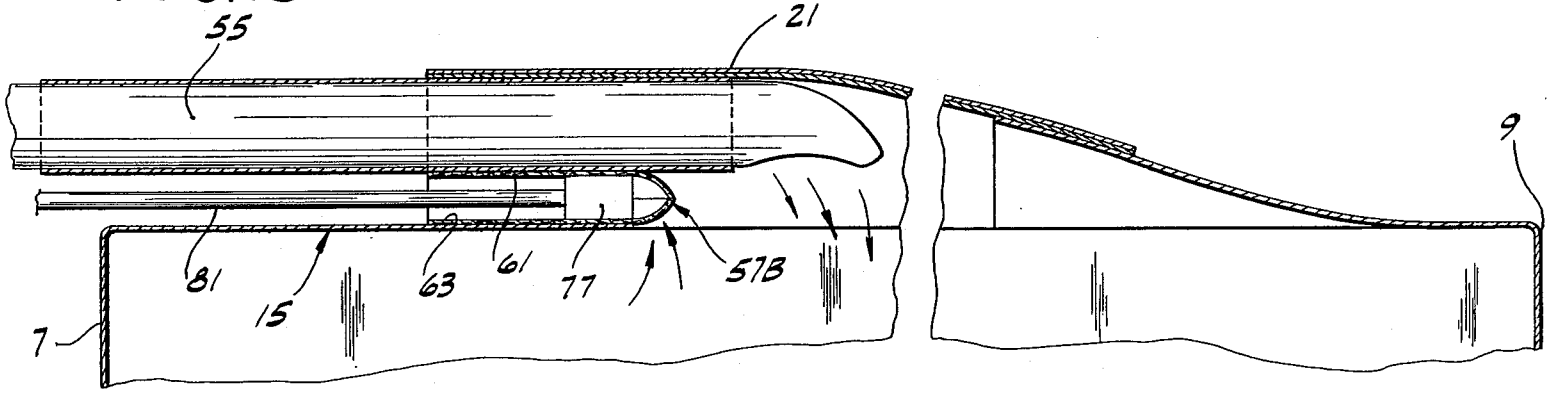
FIG. 15 is view in section similar to FIG. 13 showing the FIG. 11 bag placed on a filling spout and a vacuum member inserted under the valve sleeve for exhausting air from the bag through the filter.
Figure 14:
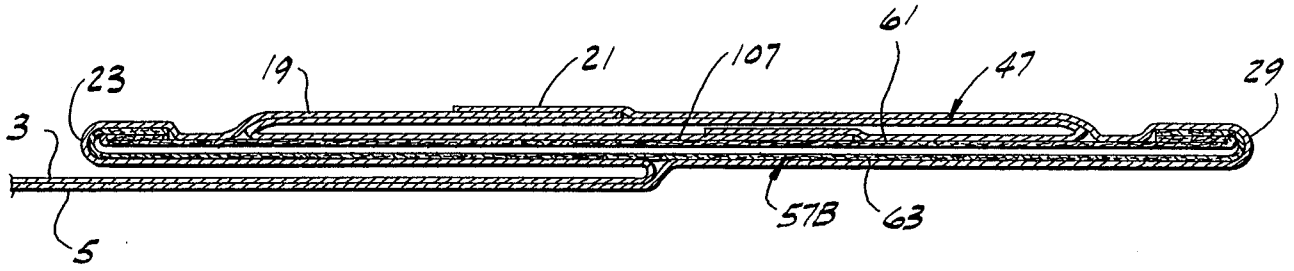
FIG. 14 is a section similar to FIGS. 4 and 9 of FIG. 11 showing both the valve and the filter.

FIGS. 11–15 illustrate a third embodiment of the valve bag of this invention designated in its entirety by the reference character B3, differing from the first two embodiments in that both the valve and the filter are at one and the same corner of the bag, i.e. at one end of the valve end closure of the bag, specifically its left end as illustrated in FIGS. 11–13 and 15. Apart from the location of the filter, the bag B3 is generally similar to the bag B1, corresponding parts of B3 bearing the same reference characters as used for B1. Thus, the B3 valve sleeve, which is similar to the sleeve of bags B1 and B2 except that it is shown at the left rather than the right, is again designated 47. The filter element or pocket, which is similar to the filter element or pocket 57 of the bag B1, is indicated at 57B. The filter pocket 57B is adhered on the end flap 15, as in the bag B1, but the valve sleeve 47, instead of being secured on the end flap 17, is secured on top of the filter pocket 57B, as by means of adhesive at 107. In the filling of the bag B3, the vacuum member 77 is inserted in the pocket 57B underneath the spout 55 inserted in the sleeve 47 thereabove, as shown in FIG. 15.

Figure 11:
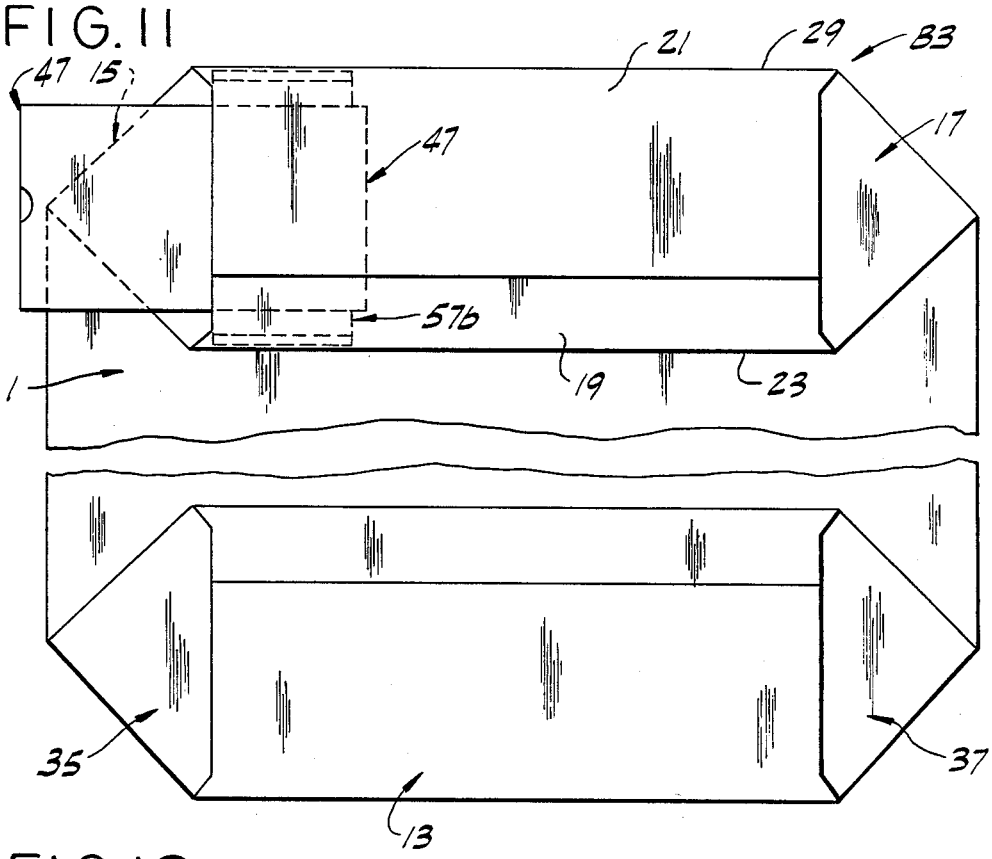
FIG. 11 is a view similar to FIGS. 1 and 6 of a third embodiment of the valve bag of this invention, in which the valve and the filter are at the same end (here the left end) of one of the bag end closures, the filter being of "hinge-type" construction as in the FIG. 1 embodiment (but under the valve), the central portion of the bag being broken away to reduce the height of the view.
Figure 12:
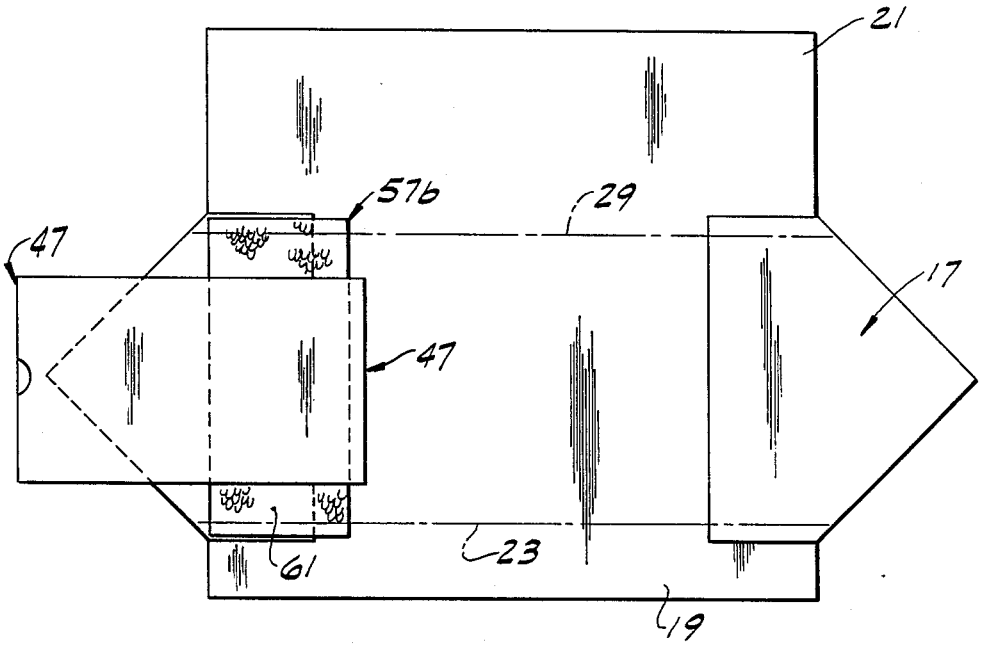
FIG. 12 is a view of the valved end closure of the FIG. 11 bag opened up.
Figure 13:
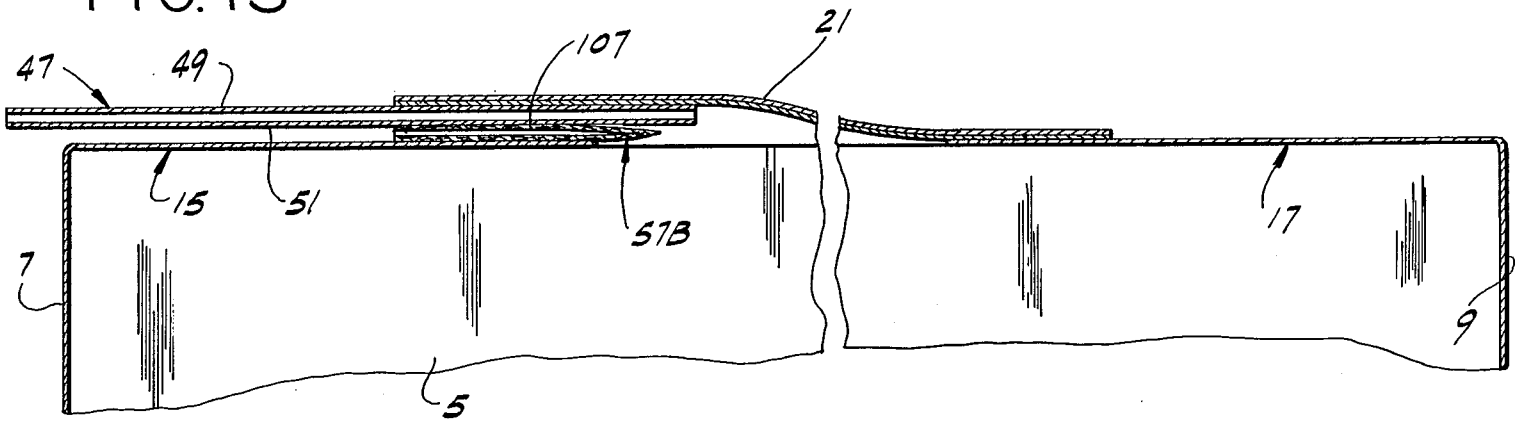
FIG. 13 is a section similar to FIGS. 3 and 8 of FIG. 11.
Figure 16:
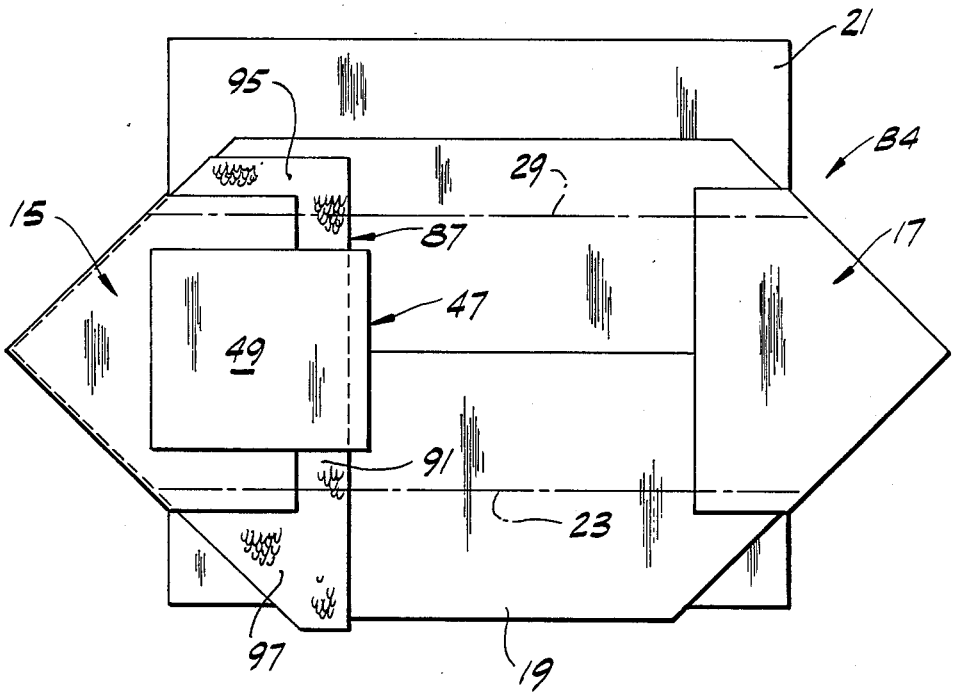
FIG. 16 is a view similar to FIG. 12 showing a fourth embodiment of the valve bag of this invention similar to the third embodiment in that the valve and the filter are at the same end (the left end as shown) of one of the valved end closure of the bag, but differing from the third embodiment in that the filter is of the "structural strip type" construction.
Figure 17:
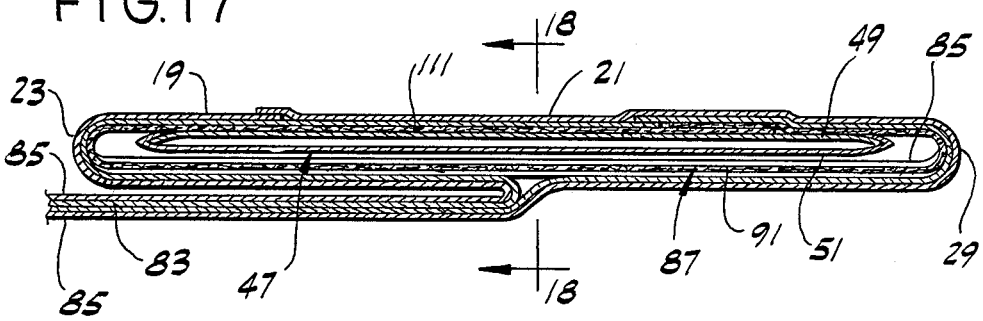
FIG. 17 is a section similar to FIG. 14 of the fourth embodiment.
Figure 18:
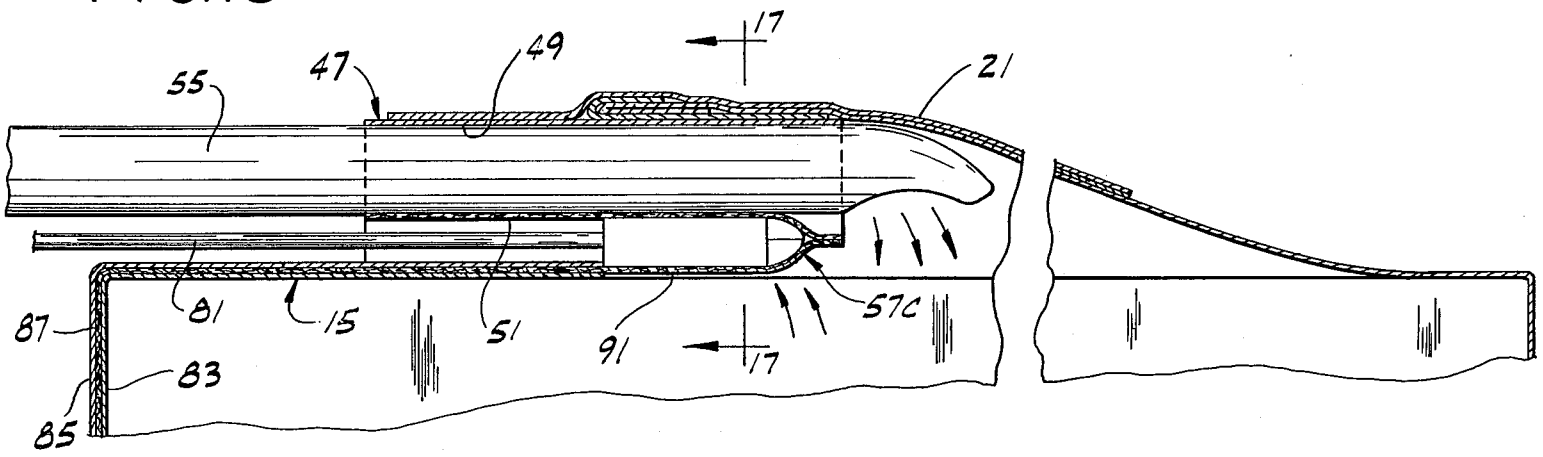
FIG. 18 is a section similar to FIG. 15 showing the FIG. 16 bag placed on a filling spout and a vacuum member inserted under the valve sleeve.
Figure 19:
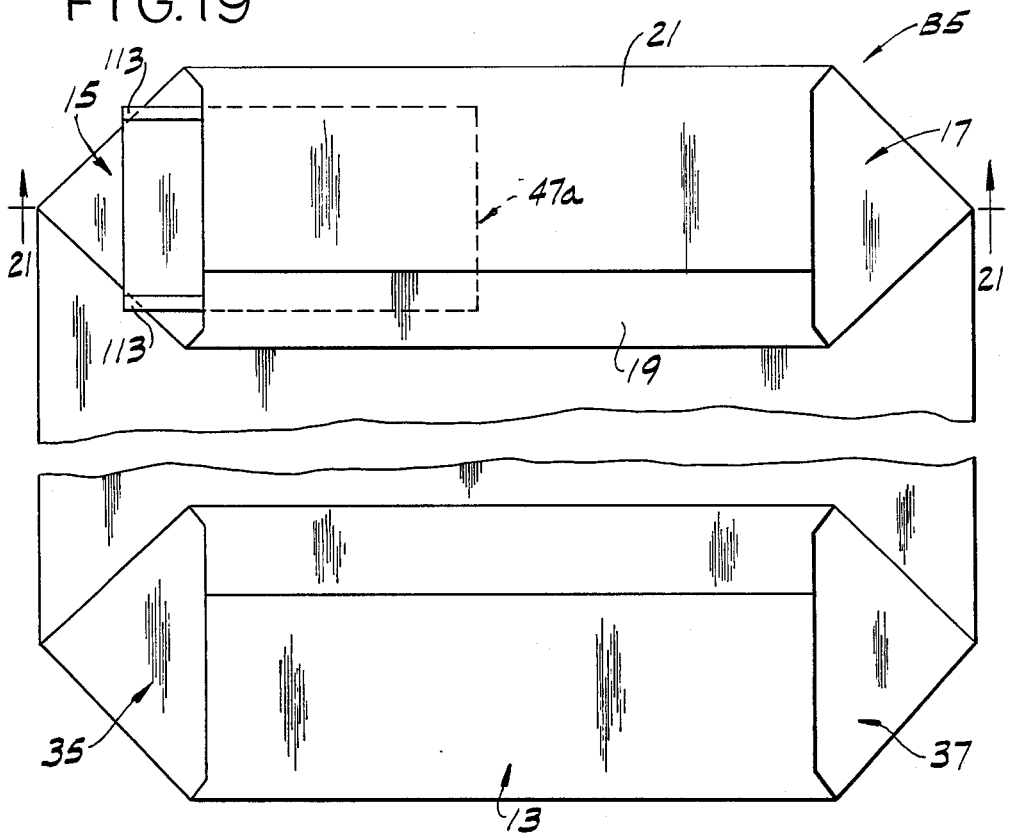
FIG. 19 is a view similar to FIGS. 1, 6 and 11 showing a fifth embodiment.
Figure 20:
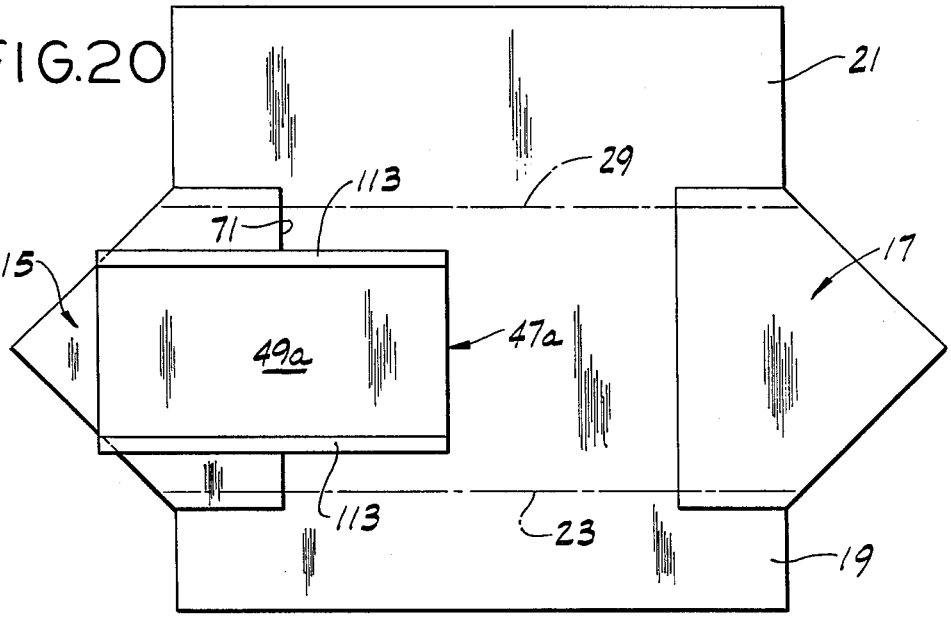
FIG. 20 is a view of the valved end closure of the FIG. 19 bag opened up.

FIGS. 16–18 illustrate a fourth embodiment of the valve bag of this invention, designated in its entirety by the reference character B4, similar to the third embodiment B3 in that both the valve and the filter are at one and the same corner of the bag, but differing from the third embodiment in that filter pocket, designated 57C, is of the structural strip type construction similar to that in the B2 embodiment, instead of being of the hinge-type construction of the B3 embodiment. Thus, the filter pocket 57C is constituted by a protruding or projecting end portion 91 of a strip 87 sandwiched between the bag plies 83 and 85 as in B3 embodiment. The valve sleeve 47 is secured at its inner end margin by adhesive as indicated at 109 to the inner end margin of the end portion 91 of strip 87, and is left free of the end flap 15 for insertion of the vacuum member between the flap 15 and the valve sleeve. The lateral portions 95 and 97 of the end portion 91 of the strip 87 are folded over on the fold lines 23 and 29 with the side flaps 19 and 21 (as in the B3 embodiment), but in this case these portions 95 and 97 (together with the side flaps) overlie the valve sleeve and are secured to the latter by adhesive at 111. As completed, the valved end closure of the B4 bag on the outside resembles the valved end closure of the B3 bag as shown in FIG. 11, so no additional view of the B4 bag corresponding to FIG. 11 is presented.

In the filling of the bag B4, the vacuum member 77 is inserted in the pocket 57C underneath the spout 55 inserted in the sleeve 47 thereabove, as shown in FIG. 18 (similar to FIG. 15).

Figure 21:
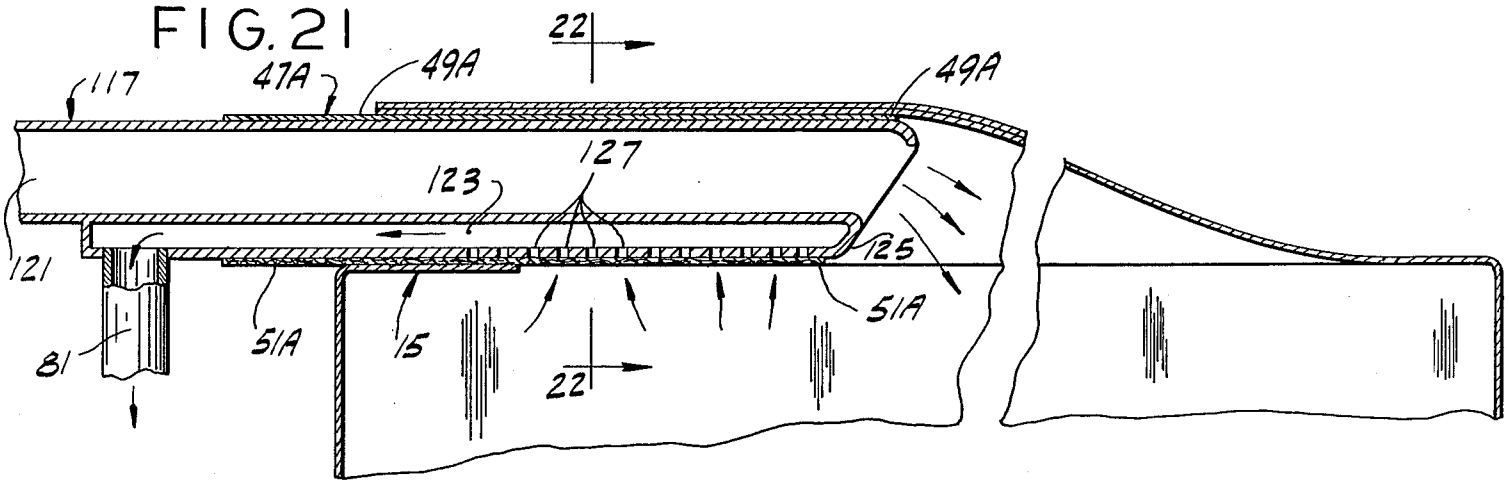
FIG. 21 is a section similar to FIGS. 10 and 18 showing the FIG. 19 bag placed on a combination filling spout and vacuum member.
Figure 22:
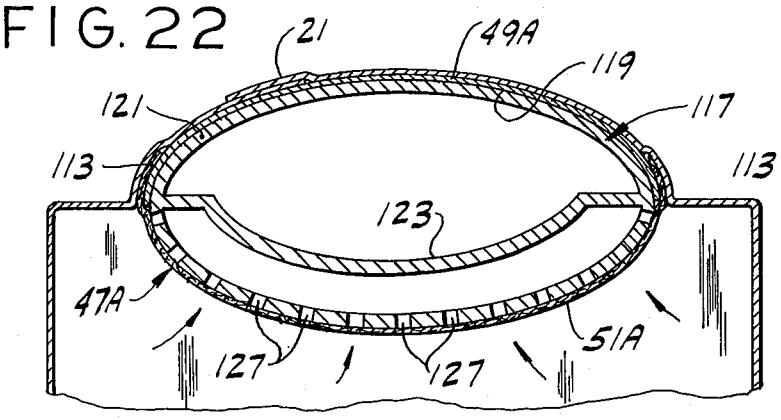
FIG. 22 is a section on line 22—22 of FIG. 21.

FIGS. 19–22 illustrate a fifth embodiment of the valve bag of this invention, designated in its entirety by the reference character B5, wherein the filter is constituted as part of the valve sleeve. Thus, the latter, designated in its entirety by the reference numeral 47A, consists of a flat open-ended tube comprising an upper wall 49A of paper or the like and a lower wall 51A of filter material such as heretofore mentioned, these walls being joined at their side margins all along the sides of the sleeve as indicated at 113 as by means of a suitable adhesive. The bottom wall 51A, which constitutes the filter, is adhered at 115 on the end flap 15. The side flaps 19 and 21 are folded over as before and adhered to each other, also being adhered to the top wall 49A of the sleeve. The sleeve extends beyond the inner end edge 71 of the end flap 15 into the bag. In filling the bag B5, a combination spout and vacuum member 117 is inserted in the passage 119 formed by the sleeve, this member having an upper tubular section 121 constituting the spout and a lower hollow section 123 constituting a vacuum member. The upper tubular section is open at its inner end for delivery of product into the bag. The lower hollow section is closed at its inner end as indicated at 125 and is shown as having openings 127 in its bottom adjacent its inner end which, when the member is fully inserted in the sleeve as shown in FIG. 21, is located inwardly of the inner end edge 71 of the end flap 15, in register with the portion of the filter 51A extending beyond said inner end edge. The member 117 has a relatively snug fit in the sleeve 47A, as shown in FIGS. 21 and 22, so that the sleeve is in close contact with the member 117 all around the member. As product is delivered through the spout section 121 of member 117 into the bag, air is evacuated from the bag through the filter 51A via the openings 127 and the vacuum section 123 of member 117.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag having end closures and a valve in one of the end closures adapted to be opened for placement of the bag on a filling spout for filling the bag with product, said one end closure having a passage for insertion of a vacuum member for exhausting air from the bag as the bag is filled, and a filter for said passage constituted by flexible sheet filter material which is air permeable for passage of air from the bag into said vacuum member but product impermeable to inhibit escape of product from the bag, said sheet filter material being secured to the bag, said filter defining a pocket for insertion of the vacuum member, wherein the valve comprises a valve sleeve and the sleeve and the pocket are at one and the same corner at one end of said one end closure.

2. A bag as set forth in claim 1 wherein the pocket is under the sleeve.

3. A bag having end closures and a valve in one of the end closures adapted to be opened for placement of the bag on a filling spout for filling the bag with product, said one end closure having a passage for insertion of a vacuum member for exhausting air from the bag as the bag is filled, and a filter for said passage constituted by flexible sheet filter material which is air permeable for passage of air from the bag into said vacuum member but product impermeable to inhibit escape of product from the bag, said sheet filter material being secured to the bag, both the valve and the filter being at one and the same corner at one end of said one end closure, the valve forming a passage for the filling spout and this passage being also the passage for the vacuum member, the valve comprising a valve sleeve and the filter being part of the sleeve, wherein the sleeve comprises a flat tube having a top half and a bottom half joined at the sides of the tube, the bottom half being of filter material and constituting the filter.

4. A valve bag having an end closure at one end constituting the valve end of the bag, said closure comprising inwardly directed end flaps at the corners of the bag at said end and first and second side flaps, the first side flap being folded over on a first fold line extending transversely of the bag and the second being folded over on a second fold line extending transversely of the bag and overlying the first, a valve at one of said corners comprising a valve sleeve extending into the bag between the end flap at that corner and the side flaps, said valve sleeve being adapted to be opened for placement of the bag on a filling spout for filling the bag with product, and a filter vent for the bag at the opposite corner comprising a pocket of flexible sheet filter material which is air permeable for passage of air from the bag through the material but product impermeable to inhibit escape of product from the bag, said pocket being secured to the opposite end flap and to said folded-over side flaps and extending into the bag from the opposite end flap, said pocket being open at its outer end for insertion of a vacuum member for exhausting air from the bag as the bag is filled.

5. A valve bag as set forth in claim 4 wherein the pocket comprises a piece of the filter material folded on a fold line forming an inner closed end for the pocket and having a bottom wall and a top wall, the bottom wall being secured on top of the said opposite end flap and the folded-over side flaps being secured to the top wall, the folded end portion of the pocket extending into the bag beyond the inner end edge of said opposite end flap.

6. A valve bag as set forth in claim 4 formed from a tube comprising a plurality of paper plies wherein the pocket is formed by the end portion of a strip of filter material sandwiched between the plies extending lengthwise of the tube with said end portion extending out the tube and projecting inwardly beyond the inner end edge of said opposite end flap, said end portion of the strip having side portions folded over with the side flaps so that said projecting end portion has a bottom wall and a top wall, said bottom and top walls being joined at the side margins thereof along the fold lines on which said side portions are folded over with said side flaps, said top and bottom walls being secured together at the inner end thereof to form the pocket.

7. A valve bag having an end closure at one end constituting the valve end of the bag, said closure comprising inwardly directed end flaps at the corners of the bag at said end and first and second side flaps, the first side flap being folded over on a first fold line extending transversely of the bag and the second being folded over on a second fold line extending transversely of the bag and overlying the first, a valve at one of said corners comprising a valve sleeve extending into the bag between the end flap at that corner and the side flaps adapted to be opened for placement of the bag on a filling spout for filling the bag with product, and a filter vent for the bag at said one corner comprising a pocket of flexible sheet filter material which is air permeable for passage of air from the bag through the material but product impermeable to inhibit escape of product from the bag, said pocket being between said end flap at said one corner and said valve sleeve and being open at its outer end for insertion of a vacuum member underneath the spout for exhausting air from the bag as the bag is filled.

8. A valve bag as set forth in claim 7 wherein the pocket comprises a piece of the filter material folded on a fold line forming an inner closed end for the pocket and having a bottom half and a top half, the bottom half of the pocket being secured on top of the end flap at said one corner and the valve sleeve being secured to the top half of the pocket.

9. A valve bag as set forth in claim 7 formed from a tube comprising a plurality of paper plies wherein the pocket is formed by the end portion of a strip of filter material sandwiched between the plies extending lengthwise of the tube with said end portion extending out the tube projecting inwardly beyond the inner end edge of said end flap at said one corner, said end portion of the strip having side portions folded over with the side flaps so that said end portion has a bottom section and a top section, said bottom and top sections being joined at the side margins thereof along the fold lines on which said side portions are folded over with said side flaps, said bottom section underlying the valve sleeve and being secured to the valve sleeve at the inner end thereof to form the pocket, said top section overlying the valve sleeve.

10. A valve bag having an end closure at one end constituting the valve end of the bag, said closure comprising inwardly directed end flaps at the corners of the bag at said end and first and second side flaps, the first side flap being folded over on a first fold line extending transversely of the bag and the second being folded over on a second fold line extending transversely of the bag and overlying the first, a valve at one of said corners comprising a valve sleeve extending into the bag between the end flap at that corner and the side flaps adapted to be opened for placement of the bag on a filling spout for filling the bag with product, said valve sleeve comprising a flat tube having a top half and a bottom half joined at the sides of the tube, the bottom half being of flexible sheet filter material which is air permeable for passage of air from the bag to a vacuum member under the spout but product impermeable to inhibit escape of product from the bag.

* * * * *